US005953876A

United States Patent [19]

Agar

[11] Patent Number: 5,953,876

[45] Date of Patent: Sep. 21, 1999

[54] WALL FRAMING SYSTEM AND METHOD FOR ITS MANUFACTURE

[76] Inventor: Robert S. Agar, 150 Ferrier St., Unit 14, Markham, Ontario, Canada, L3R 3K3

[21] Appl. No.: 08/414,754

[22] Filed: Mar. 31, 1995

[51] Int. Cl.[6] ..... E04B 2/30

[52] U.S. Cl. ..... 52/489.1; 52/481.1; 52/481.2; 52/489.2

[58] Field of Search ..... 52/481.2, 481.1, 52/489.1, 489.2

[56] References Cited

U.S. PATENT DOCUMENTS

| | | | |
|---|---|---|---|
| 1,810,597 | 6/1931 | Corwin . | |
| 1,814,202 | 7/1931 | Winget . | |
| 1,876,528 | 9/1932 | Walters . | |
| 1,915,697 | 6/1933 | Robinson . | |
| 2,055,442 | 9/1936 | Jones | 72/118 |
| 2,101,001 | 11/1937 | Balduf | 12/118 |
| 2,642,968 | 6/1953 | Roush et al. | 189/86 |
| 3,461,638 | 8/1969 | Balinski | 52/732 |
| 3,482,369 | 12/1969 | Burke | 52/669 |
| 3,534,516 | 10/1970 | Cooper | 52/212 |
| 3,948,011 | 4/1976 | Price et al. | 52/241 |
| 4,128,979 | 12/1978 | Price | 52/481 X |
| 4,194,333 | 3/1980 | Paton et al. | 52/235 |
| 4,245,448 | 1/1981 | Agar | 52/489 |
| 4,448,004 | 5/1984 | Thorsell | 52/241 |
| 4,651,484 | 3/1987 | Rutkowski | 52/241 |
| 4,693,047 | 9/1987 | Menchetti | 52/489.1 X |
| 4,719,730 | 1/1988 | Winkowski | 52/238.1 |
| 4,811,539 | 3/1989 | Menchetti | 52/486 X |
| 4,837,988 | 6/1989 | Menchetti et al. | 52/36 |
| 5,216,859 | 6/1993 | Moreno et al. | 52/238.1 |

FOREIGN PATENT DOCUMENTS

| | | | |
|---|---|---|---|
| 1314682 | 3/1993 | Canada | E04B 5/52 |
| WO8902502 | 3/1989 | WIPO | E04B 1/60 |

*Primary Examiner*—Wynn E. Wood
*Assistant Examiner*—W. Glenn Edwards
*Attorney, Agent, or Firm*—Mark R. Wisner

[57] ABSTRACT

A wall frame has C-shaped vertical studs each with a web having vertically spaced openings with an outline conforming to the cross-sectional shape of a short channel member. The two legs depending from the web have a plurality of depending tabs punched therefrom. These tabs extend into vertical registration with the top and bottom edges of each opening such that when a short channel member is inserted through the stud it is supported by the opening and by the tabs and is thereby stabilized in position. The short channel members have plastic spring clips snapped thereto. A gypsum board panel with clips attached thereto may then be mounted to the wall frame by clipping the clips to the horizontal channel members. The spring fingers of the plastic clips on the short channel members abut the gypsum board panel to dampen vibration.

19 Claims, 2 Drawing Sheets

WALL FRAMING SYSTEM AND METHOD FOR ITS MANUFACTURE

BACKGROUND OF THE INVENTION

1. Field of the Invention

This invention relates to apparatus for use in a wall framing, a wall frame, and a method for the manufacture of apparatus for use in a wall frame.

2. Description of the Related Art

U.S. Pat. No. 4,128,979 issued Dec. 12, 1978 to Price describes a wall frame comprised of vertical studs and horizontal channel members. The vertical studs have a series of horizontally aligned openings and a horizontal channel member extends through each set of aligned openings. The frame may demountably mount a gypsum board panel with a plurality of clips attached thereto. More particularly, a number of gang nail plates, each with a clip in the nature of a finger downwardly depending therefrom, may be hammered into a gypsum board panel. The panel may then be supported by the channel members of the wall framing system by setting the clips of the board onto the horizontal channel members. A difficulty with this wall frame is that the horizontal channel members extending along the wall cavity make it difficult to provide vertical electrical conduit within the cavity.

U.S. Pat. No. 4,811,539 issued Mar. 14, 1989 to Menchetti provides a wall frame for gypsum board panels which can accommodate vertical conduit. In Menchetti, special U-shaped studs have two parallel web portions with aligned openings. Each pair of aligned openings tightly receives a short horizontal channel member. Thereafter, a gypsum board panel with clips of the type described hereinbefore may be clipped into the horizontal short channel members. Blocks of wood may be provided at the free ends of the short channel members to prevent the gypsum board rattling against the short channel members. Alternatively, the short channel members may be provided with metal tags which press against the board panel.

Menchetti uses a specially designed stud and field assembly of Menchetti's frame may prove time consuming as the short channel members must be inserted in the firmly holding openings in the U-shaped stud.

This invention seeks to overcome drawbacks of the known prior art.

SUMMARY OF THE INVENTION

According to the present invention, there is provided apparatus for use in a wall frame comprising: a longitudinally elongated C-shaped stud having a medial web with two parallel legs depending therefrom, said web having a plurality of openings spaced along the length of said stud, each of said openings having a first transverse edge and an opposed second transverse edge, said legs having a plurality of depending tabs spaced along the length of said stud such that, for each one of said openings, there is at least one tab spaced longitudinally from said one opening and extending longitudinally substantially into registration with said first transverse edge of said one opening; a plurality of short channel members for reception in said openings such that a channel member, when received in an opening, is supported at least by said first transverse edge of said opening and by said tab which extends substantially into registration with said first transverse edge.

In accordance with another aspect of the present invention, there is provided a wall frame comprising a plurality of vertical C-shaped studs having a medial web and two parallel legs depending therefrom, said web having a plurality of vertically spaced openings, each of said openings having upper and lower transverse edges, said legs having a plurality of vertically spaced depending tabs with a tab associated with each one of said openings extending from below said opening substantially into vertical registration with said lower transverse edge of said one opening; a plurality of short channels received by said openings such that each channel is supported by said lower transverse edge of one opening and by said tab associated with said one opening.

In accordance with a further aspect of the present invention, there is provided a method for constructing apparatus for use in a wall frame comprising the steps of: in a C-shaped stud having a web and two parallel legs depending therefrom, punching a plurality of longitudinally spaced openings in said web, each of said openings having opposed transverse edges; punching a plurality of longitudinally spaced depending tabs from at least one of said two legs such that, for each one of said openings, there is a pair of said tabs each spaced longitudinally from said one opening, with one of said pair extending substantially into registration with one of said opposed transverse edges of said one opening and the other of said pair extending substantially into registration with the other of said opposed transverse edges of said one opening; cutting a plurality of short channels, each having a cross-section conforming to an outline of said openings.

BRIEF DESCRIPTION OF THE DRAWINGS

In the Figures which disclose example embodiments of the invention.

DESCRIPTION OF THE PREFERRED EMBODIMENTS

Figure 1:
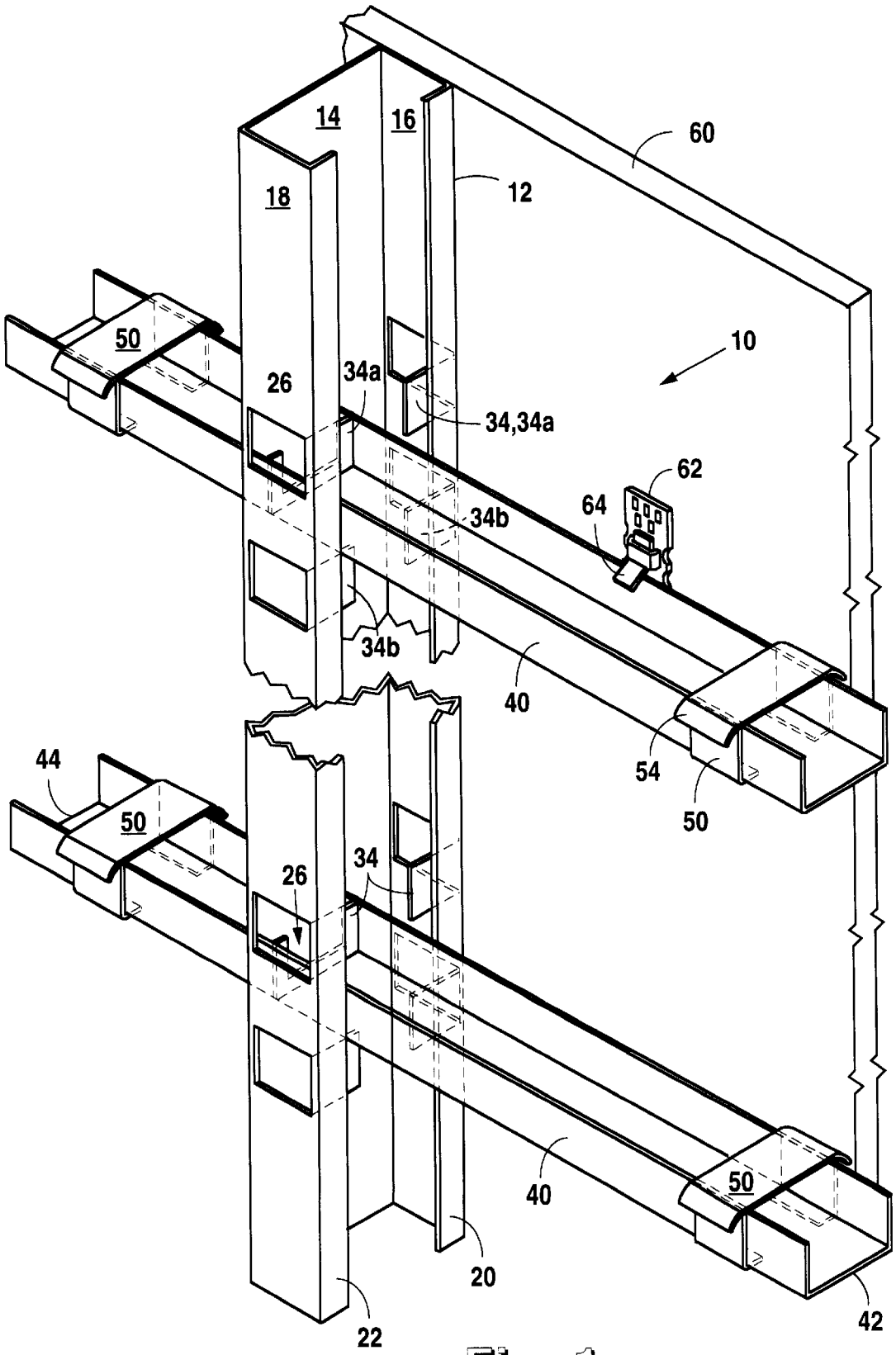
FIG. 1 is perspective view of a portion of a wall frame made in accordance with this invention.

With reference to FIGS. 1 and 2*a*, 2*b*, 2*c*, a wall frame 10 comprises a C-shaped stud 12 with a medial web 14 and two parallel legs 16 and 18 depending therefrom. The legs 16 and 18 terminate in inwardly directed flanges 20 and 22, respectively.

Figure 2A:
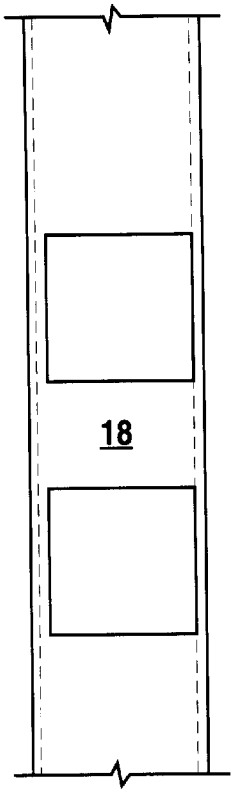
FIGS. 2*a*, 2*b*, and 2*c* are side, front, and plan views respectively of a portion of the wall frame of FIG. 1.
Figure 2B:
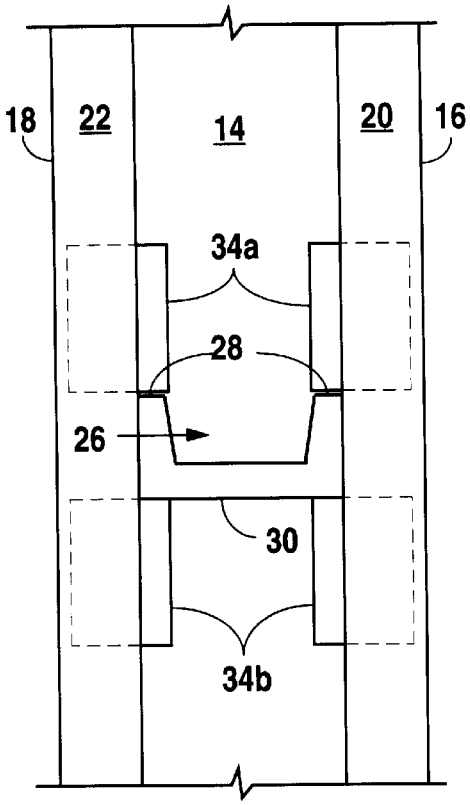
Figure 2C:
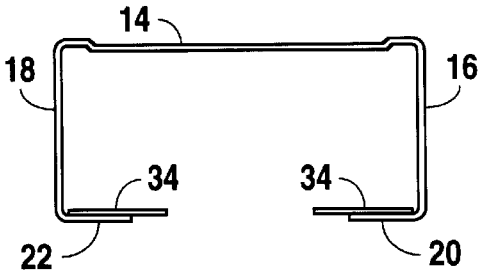

Web 14 has a plurality of vertically spaced openings 26. As seen in FIG. 2*b*, each opening has an upper transverse edge 28 and a lower transverse edge 30.

Legs 16 and 18 have a plurality of tabs 34 depending therefrom. The tabs are arranged in pairs of tabs 34*a*, 34*b* associated with each opening 26. Each tab 34*a* extends from above an opening 26 substantially into vertical registration with the upper transverse edge 28 of the opening 26. This is best seen in FIG. 2*b*. The other tab 34*b* of the pair of tabs 34*a*, 34*b* extends from below opening 26 substantially into vertical registration with the lower transverse edge 30 of the opening 26. It will be noted that both legs 16 and 18 have pairs of tabs 34*a*, 34*b* such that there are four tabs surrounding each opening 26. Opening 26 has a channel-shaped outline.

A plurality of short channels 40 have a cross-sectional shape conforming to the outline of openings 26. One short channel 40 is received through each opening in vertical stud 12 such that the channel 40 is supported by the upper 28 and lower 30 transverse edges of the opening and by the pairs of tabs 34*a*, 34*b* surrounding the opening. Because the tabs depending from legs 16, 18 are horizontally spaced from the opening 26 through the web 14 of stud 12, short channel 40 is supported at two horizontally spaced points and is stabilized in a horizontal orientation.

Figure 3:
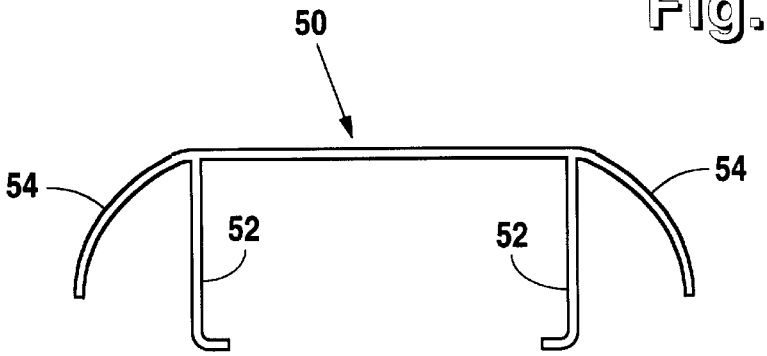
FIG. 3 is a side view of a portion of the wall frame of FIG. 1.

As best seen in FIG. 3, resilient plastic clip 50 has legs 52 which allow it to be snapped to each short channel 40 (of FIG. 1) proximate either end 42, 44 of the channel. Each plastic clip 50 also has a resilient finger 54 which extends outwardly from the short channel 40 on which it is supported.

The wall frame 10 may support a gypsum board panel 60 after a number of gang nail mounted clips 62 have been hammered into the panel 60. More particularly, two clips 62 are provided for each channel 40, with the clip finger 64 of one clip 62 set into the channel on one side of stud 12 and the clip finger of the other clip set into the channel 40 on the other side of stud 12. When a panel 60 is supported by the wall frame 10, the panel rests against spring fingers 54 of clips 50. Since these fingers are plastic and resilient, they dampen any vibration imparted to panels 60 which minimizes sound transmission.

In order to construct the studs 12 for use in wall frame 10, a standard C-shaped stud has a series of longitudinally spaced openings 26 punched in its web. Next, depending tabs 34 are punched from legs 16, 18 of the stud by cutting out the tab on three sides and then bending it inwardly along a fourth side. A plurality of short channels 40 may be cut from a smaller diameter standard C-shaped channel member.

Modifications will be apparent to those skilled in the art and, therefore, the invention is defined in the claims.

What is claimed is:

1. Apparatus for use in a wall frame comprising:

a longitudinally elongated C-shaped stud having a medial web with two parallel legs depending therefrom, said web having a plurality of openings spaced along the length of said stud, each of said openings having a first transverse edge and an opposed second transverse edge, said legs having a plurality of depending tabs spaced along the length of said stud such that, for each one of said openings, there is at least one tab spaced longitudinally from said one opening and extending longitudinally substantially into registration with said first transverse edge of said one opening;

a plurality of short channel members for reception in said openings such that a channel member, when received in an opening, is supported at least by said first transverse edge of said opening and by said tab which extends substantially into registration with said first transverse edge.

2. The apparatus of claim 1 including a plurality of resilient plastic clips, each of said clips sized for snap-fitting to one of said plurality of short channel members, each of said clips having at least one resilient finger positioned so as to extend generally transversely of any channel piece to which it is snap fit.

3. Apparatus for use in a wall frame comprising:

a longitudinally elongated C-shaped stud having a medial web with two parallel legs depending therefrom, said web having a plurality of openings spaced along the length of said stud, each of said openings having opposed transverse edges, said legs having a plurality of depending tabs spaced along the length of said stud such that, for each one of said openings, there is a pair of said tabs with each tab spaced longitudinally from said one opening, one of said pair extending substantially into registration with one of said opposed transverse edges of said one opening and the other of said pair extending substantially into registration with the other of said opposed transverse edges of said one opening;

a plurality of short channel members for reception in said openings such that each channel is supported by said opposed transverse edges of one opening and by said pair of tabs.

4. The apparatus of claim 3 including a plurality of resilient plastic clips, each of said clips sized for snap-fitting to one of said plurality of short channel members, each of said clips having at least one resilient finger positioned so as to extend generally transversely of any channel piece to which it is snap fit.

5. The apparatus of claim 3 wherein said opening outlines the cross-sectional shape of said plurality of short channel members.

6. The apparatus of claim 5 wherein each of said plurality of short channel members has a C-shaped cross-sectional shape.

7. A wall frame comprising a plurality of vertical C-shaped studs having a medial web and two parallel legs depending therefrom, said web having a plurality of vertically spaced openings, each of said openings having upper and lower transverse edges, said legs having a plurality of vertically spaced depending tabs with a tab associated with each one of said openings extending from below said opening substantially into vertical registration with said lower transverse edge of said one opening;

a plurality of short channels received by said openings such that each channel is supported by said lower transverse edge of one opening and by said tab associated with said one opening.

8. The apparatus of claim 7 including a resilient plastic clip snap fit proximate either end of each of said plurality of short channels, each of said clips having at least one resilient finger extending generally transversely of said channel member for resiliently supporting a section of wall.

9. A wall frame comprising:

a plurality of vertical C-shaped studs having a medial web and two parallel legs depending therefrom, said web having a plurality of vertically spaced openings, each of said openings having upper and lower transverse edges, said legs having a plurality of vertically spaced depending tabs with a pair of said tabs associated with each one of said openings, one of said pair of tabs extending from above said one opening substantially into vertical registration with said upper transverse edge of said one opening and the other of said pair extending from below said opening substantially into vertical registration with said lower transverse edge of said one opening;

a plurality of short channels received by said openings such that each channel is supported by said upper and lower transverse edges of one opening and by said pair of tabs.

10. The wall frame of claim 9 wherein each of said pairs of tabs depends from one of said two legs and comprising, associated with each of said openings, a second pair of said tabs depending from the other of said two legs, one tab of each of said second pair of tabs extending from above said one opening substantially into vertical registration with said upper transverse edge of said one opening and the other of said second pair extending from below said opening substantially into vertical registration with said lower transverse edge of said one opening.

11. The wall frame of claim 10 including a resilient plastic clip snap fit proximate either end of each of said plurality of short channels, each of said clips having at least one resilient finger extending generally transversely of said channel for resiliently supporting a section of wall.

12. The wall frame of claim 11 wherein said opening outlines the cross-sectional shape of said plurality of short channels.

13. The wall frame of claim 12 wherein each of said plurality of short channels has a C-shaped cross-sectional shape.

14. A method for constructing apparatus for use in a wall frame comprising the steps of:

in a C-shaped stud having a web and two parallel legs depending therefrom, punching a plurality of longitudinally spaced openings in said web, each of said openings having opposed transverse edges;

punching a plurality of longitudinally spaced depending tabs from at least one of said two legs such that, for each one of said openings, there is a pair of said tabs each spaced longitudinally from said one opening, with one of said pair of tabs extending substantially into registration with one of said opposed transverse edges of said one opening and the other of said pair extending substantially into registration with the other of said opposed transverse edges of said one opening;

cutting a plurality of short channels, each having a cross-section conforming to an outline of said openings.

15. The method of claim 14 wherein the step of punching a plurality of vertically spaced depending tabs from at least one of said two legs comprises punching tabs from both of said legs such that, for each opening, said pair of tabs depend from one of said legs and there is a second pair of tabs depending from the other of said two legs, each of said second pair of tabs spaced longitudinally from said one opening, with one of said second pair of tabs extending substantially into registration with one of said opposed transverse edges of said one opening and the other of said second pair of tabs extending substantially into registration with the other of said opposed transverse edges of said one opening.

16. Apparatus for use in a wall frame comprising:

a longitudinally elongated C-shaped stud having a medial web with two parallel legs depending therefrom, said web having a plurality of openings spaced along the length of said stud, each of said openings having opposed transverse edges, one of said legs having a plurality of pairs of depending tabs spaced along the length of said one stud such that, for each one of said openings, there is a pair of said tabs with each tab spaced longitudinally from said one opening, one of said pair extending substantially into registration with one of said opposed transverse edges of said one opening and the other of said pair extending substantially into registration with the other of said opposed transverse edges of said one opening;

for each of said openings, a second pair of said tabs depending from the other of said two legs, each of said second pair of tabs spaced longitudinally from said one opening, one of said second pair extending substantially into registration with one of said opposed transverse edges of said one opening and the other of said second pair extending substantially into registration with the other of said opposed transverse edges of said one opening; and a plurality of short channel members for reception in said openings such that each channel is supported by said opposed transverse edges of one opening and by said pair of tabs.

17. The apparatus of claim 16 including a plurality of resilient clips, each of said clips sized for snap-fitting to one of said plurality of short channel members, each of said clips having at least one resilient finger positioned so as to extend generally transversely of any channel member to which it is snap fit.

18. The apparatus of claim 16 wherein said opening outlines the cross-sectional shape of said plurality of short channel members.

19. The apparatus of claim 18 wherein each of said plurality of short channel members has a C-shaped cross-sectional shape.

* * * * *